US012064847B2

(12) United States Patent
Suzuki

(10) Patent No.: US 12,064,847 B2
(45) Date of Patent: Aug. 20, 2024

(54) PROCESSING METHOD OF WORKPIECE

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 132 days.

(21) Appl. No.: 17/656,354

(22) Filed: Mar. 24, 2022

(65) Prior Publication Data

US 2022/0324082 A1 Oct. 13, 2022

(30) Foreign Application Priority Data

Apr. 7, 2021 (JP) ..... 2021-065241

(51) Int. Cl.

| | |
|---|---|
| ***B24B 7/04*** | (2006.01) |
| ***B24B 7/22*** | (2006.01) |
| ***B24B 37/27*** | (2012.01) |
| ***B24B 37/34*** | (2012.01) |

(52) U.S. Cl.

CPC ..... *B24B 37/345* (2013.01); *B24B 7/04* (2013.01); *B24B 7/228* (2013.01); *B24B 37/27* (2013.01)

(58) Field of Classification Search

CPC ..... B24B 37/04; B24B 37/042; B24B 37/10; B24B 7/04; B24B 7/228; B24B 27/0076; B24B 7/22

USPC ..... 451/41, 177, 283

See application file for complete search history.

(56) References Cited

U.S. PATENT DOCUMENTS

2016/0064230 A1* 3/2016 Nishihara ..... B24B 37/042 451/41

FOREIGN PATENT DOCUMENTS

JP 2014124690 A 7/2014

* cited by examiner

*Primary Examiner* — Abbie E Quann

(74) *Attorney, Agent, or Firm* — Greer, Burns & Crain, Ltd.

(57) ABSTRACT

There is provided a processing method of grinding a workpiece. The processing method includes a holding step of holding the workpiece on a side of its front surface on a chuck table, a coarse grinding step of grinding the workpiece on a side of its back surface with first grinding stones until the workpiece has a predetermined thickness, an auxiliary grinding step of grinding the workpiece on the side of its back surface with the first grinding stones such that an unground region remains at an outer peripheral portion of the workpiece, an unground region grinding step of grinding the unground region with second grinding stones having an average abrasive grain size smaller than that of the first grinding stones, and a finish grinding step of grinding the workpiece on the side of its back surface with the second grinding stones until the workpiece has a predetermined finish thickness.

18 Claims, 7 Drawing Sheets

PROCESSING METHOD OF WORKPIECE

BACKGROUND OF THE INVENTION

Field of the Invention

The present invention relates to a processing method of a workpiece, which is useful in grinding workpieces, for example, wafers.

Description of the Related Art

In a manufacturing process of device chips, a wafer with devices formed in respective regions defined by a plurality of intersecting streets (scheduled division lines) is used. By dividing this wafer along the streets, the device chips are obtained with the devices included therein respectively. Such device chips are incorporated in various kinds of electronic equipment such as mobile phones and personal computers.

In recent years, along with the downsizing of electronic equipment, there is an increasing need for thinner device chips. Before dividing a wafer, a thinning step may therefore be performed by grinding the wafer with a grinding apparatus. The grinding apparatus includes a chuck table that holds a workpiece thereon, and a grinding unit that applies grinding processing to the workpiece. A spindle is incorporated in the grinding unit, and a grinding wheel with grinding stones included thereon is mounted on a distal end portion of the spindle. The grinding apparatus grinds and thins the workpiece by rotating the grinding wheel and bringing the rotating grinding stones into contact with the workpiece (see JP 2014-124690A).

SUMMARY OF THE INVENTION

When a workpiece is ground by a grinding apparatus, coarse grinding and finish grinding are performed sequentially. Described specifically, the workpiece is first ground with grinding stones containing abrasive grains of large grain size until the workpiece is thinned to a predetermined thickness (coarse grinding step). The workpiece is then ground with grinding stones containing abrasive grains of small grain size until the workpiece is thinned to a finish thickness (finish grinding step). The combined use of coarse grinding and finish grinding allows fewer processing marks to remain on the workpiece after the grinding while making the grinding time shorter.

In a final stage of the coarse grinding, however, the grinding stones with the abrasive grains of the large grain size contained therein hit an outer peripheral portion of the workpiece which has been thinned and reduced in rigidity. As a result, processing failures such as chipping and/or cracking may occur at the outer peripheral portion of the workpiece. In particular, processing (chamfering) may be applied to remove corner portions formed on outer peripheral edges of the workpiece. In this case, the workpiece is formed at a side surface thereof into a curve shape from a front surface toward a back surface thereof. When the chamfered workpiece is thinned, an outer peripheral portion of the workpiece is formed into a sharp thin shape (sharp edge shape), so that, in the final stage of the coarse grinding step, processing failures are prone to occur at the outer peripheral portion of the workpiece.

Accordingly, the grinding of the workpiece is switched from coarse grinding to finish grinding before the workpiece is thinned to such an extent that processing failures would become prone to occur at the outer peripheral portion of the workpiece. Owing to this switch, after the workpiece has been thinned to some extent, the workpiece is ground with the grinding stones with the abrasive grains of the small grain size contained therein, and therefore the occurrence of processing failures at the outer peripheral portion of the workpiece is suppressed. Nonetheless, the progress of grinding of the workpiece is slow in the finish grinding compared with the coarse grinding, so that time takes to thin the workpiece. The grinding time required until the thickness of the workpiece reaches a target value (finish thickness) therefore increases if the removal amount of the workpiece by coarse grinding is reduced to suppress the occurrence of processing failures and the removal amount of the workpiece by finish grinding is increased.

With the foregoing problem in view, the present invention has, as an object thereof, the provision of a processing method of a workpiece, which can shorten the grinding time while the occurrence of processing failures is suppressed.

In accordance with an aspect of the present invention, there is provided a processing method of grinding a workpiece. The processing method includes a holding step of holding the workpiece on a side of a front surface thereof on a holding surface of a chuck table having an axis of rotation set along a direction perpendicular to the holding surface, a coarse grinding step of, after performing the holding step, adjusting a positional relationship between the chuck table and a first grinding wheel such that a moving path of first grinding stones, which are included on the first grinding wheel and contain first abrasive grains, overlaps the axis of rotation of the chuck table, and grinding the workpiece on a side of a back surface thereof with the first grinding stones until the workpiece has a predetermined thickness, an auxiliary grinding step of, after performing the coarse grinding step, adjusting the positional relationship between the chuck table and the first grinding wheel such that the first grinding stones overlap an inner side of an outer peripheral edge of the workpiece, and grinding the workpiece on the side of the back surface thereof with the first grinding stones such that an unground region remains at an outer peripheral portion of the workpiece, an unground region grinding step of, after performing the auxiliary grinding step, adjusting a positional relationship between the chuck table and a second grinding wheel such that a moving path of second grinding stones, which are included on the second grinding wheel and contain second abrasive grains having a smaller average grain size than that of the first abrasive grains, overlaps the axis of rotation of the chuck table, and grinding the unground region with the second grinding stones, and a finish grinding step of, after performing the unground region grinding step, grinding the workpiece on the side of the back surface thereof with the second grinding stones until the workpiece has a predetermined finish thickness.

Preferably, the processing method may further include a separation step of, after performing the coarse grinding step and before performing the auxiliary grinding step, separating the workpiece and the first grinding stones from each other.

In the processing method according to the aspect of the present invention, the first grinding stones with the abrasive grains of the large grain size contained therein and the second grinding stones with the abrasive grains of the small grain size contained therein are used. Following the coarse grinding of the workpiece with the first grinding stones, the workpiece is ground with the first grinding stones such that the unground region remains at the outer peripheral portion of the workpiece. Subsequently, with the second grinding stones, the unground region is ground and removed, and the finish grinding of the workpiece is performed.

If the above-described processing method is used, the outer peripheral portion of the workpiece is ground with the second grinding stones with the abrasive grains of the small grain size contained therein, so that the occurrence of processing failures at the outer peripheral portion of the workpiece is suppressed. Further, the workpiece is beforehand removed at a central portion thereof with the first grinding stones with the abrasive grains of the large grain size contained therein before the outer peripheral portion of the workpiece is ground with the second grinding stones. The processing feed rate can thus be increased when the outer peripheral portion of the workpiece is ground with the second grinding stones. It is accordingly possible to shorten the time to grind the workpiece while the occurrence of processing failures at the outer peripheral portion of the workpiece is suppressed.

The above and other objects, features and advantages of the present invention and the manner of realizing them will become more apparent, and the invention itself will best be understood from a study of the following description and appended claims with reference to the attached drawings depicting or showing a preferred embodiment of the invention.

DETAILED DESCRIPTION OF THE PREFERRED EMBODIMENT

Figure 1:
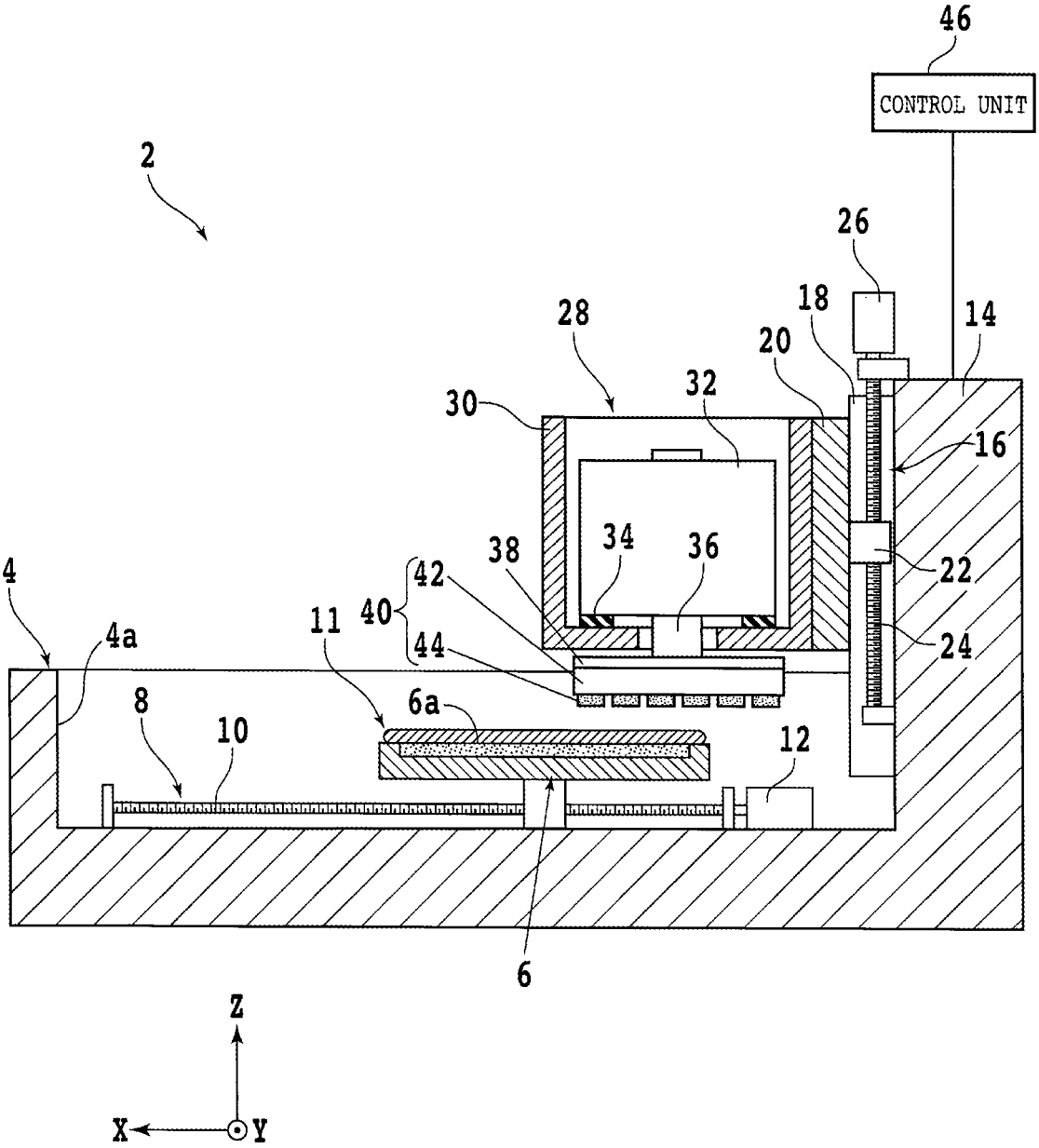
FIG. 1 is a partially cross-sectional side view depicting a grinding apparatus usable in a processing method of a workpiece (which may hereinafter be referred to as a "processing method") according to an embodiment of an aspect of the present invention.

With reference to the attached drawings, an embodiment of the aspect of the present invention will be described. First, a description will be made about a configuration example of a grinding apparatus usable in a processing method of a workpiece according to the present embodiment. FIG. 1 is a partially cross-sectional side view depicting the grinding apparatus 2. It is to be noted that, in FIG. 1, an X-axis direction (first horizontal direction, front-and-rear direction) and a Y-axis direction (second horizontal direction, left-and-right direction) are perpendicular to each other. It is also to be noted that a Z-axis direction (processing feed direction, height direction, vertical direction, up-and-down direction) is perpendicular to the X-axis direction and the Y-axis direction.

The grinding apparatus 2 includes a bed 4, which supports or accommodates individual constituent elements that make up the grinding apparatus 2. On a side of an upper surface of the base 4, a regular parallelepipedal recessed portion 4*a* is disposed. Inside the recessed portion 4*a*, a chuck table (holding table) 6 is disposed to hold a workpiece 11 as a target of processing by the grinding apparatus 2. The chuck table 6 has an upper surface, which is a flat surface substantially parallel to the X-axis direction and Y-axis direction, and a holding surface 6*a* that holds the workpiece 11 thereon.

Inside the recessed portion 4*a*, a moving mechanism (moving unit) 8 is also disposed. The moving mechanism 8 is connected to the chuck table 6 and moves the chuck table 6 along the X-axis direction. Described specifically, the moving mechanism 8 includes a ball screw 10 arranged along the X-axis direction. The ball screw 10 is in threaded engagement with a nut portion (not depicted) connected to the chuck table 6. To an end portion of the ball screw 10, a pulse motor 12 is connected to rotate the ball screw 10. When the ball screw 10 is rotated by the pulse motor 12, the chuck table 6 moves along the X-axis direction.

To the chuck table 6, a rotary drive source (not depicted) such as a motor is connected. The rotary drive source rotates the chuck table 6 about an axis of rotation that is substantially perpendicular to the holding surface 6*a* (substantially parallel to the Z-axis direction). In other words, the axis of rotation of the chuck table 6 is set along a direction perpendicular to the holding surface 6*a*.

Behind the chuck table 6 and the moving mechanism 8 (on the right side of FIG. 1), a support structure (column) 14 of a regular parallelepipedal shape is disposed. On a side of a front surface (on a forward side) of the support structure 14, a moving mechanism (moving unit) 16 is disposed. The moving mechanism 16 makes a grinding unit 28, which will be described subsequently, approach or separate relative to the chuck table 6 in a direction perpendicular to the holding surface 6*a* of the chuck table 6 (the Z-axis direction).

Described specifically, the moving mechanism 16 includes a pair of guide rails 18 fixed on the side of the front surface of the support structure 14. The paired guide rails 18 are arranged along the Z-axis direction in a state that they are apart from each other in the Y-axis direction. On the paired guide rails 18, a planar moving plate 20 is mounted on and slidably along the guide rails 18. On a side of a back surface (on a rearward side) of the moving plate 20, a nut portion 22 is disposed. Between the paired guide rails 18, a ball screw 24 is disposed along the Z-axis direction, and the ball screw 24 is in threaded engagement with the nut portion 22. To an end portion of the ball screw 24, a pulse motor 26 is connected to rotate the ball screw 24. When the ball screw 24 is rotated by the pulse motor 26, the moving plate 20 is moved (lifted or lowered) in the Z-axis direction along the guide rails 18.

On a side of a front surface (on a forward side) of the moving plate 20, the grinding unit 28 is mounted to grind the workpiece 11. The grinding unit 28 includes a hollow cylindrical support member 30 fixed on the side of the front surface of the moving plate 20. In the support member 30, a cylindrical housing 32 is accommodated. The housing 32 is supported on a side of a lower surface thereof on a bottom surface of the support member 30 via a cushion member 34 made of rubber or the like. In the housing 32, a cylindrical spindle 36 that is arranged along the Z-axis direction is accommodated. A distal end portion (lower end portion) of the spindle 36 is exposed from the housing 32, and projects downward from a lower surface of the support member 30 through an opening disposed in a bottom portion of the support member 30. To a proximal end portion (upper end portion) of the spindle 36, a rotary drive source (not depicted) such as a motor is connected to rotate the spindle 36. On the distal end portion of the spindle 36, a disc-shaped mount 38 made of metal or the like is fixed. On a side of a lower surface of the mount 38, an annular grinding wheel 40 is mounted to grind the workpiece 11. The grinding wheel 40 is fixed to the mount 38, for example, by fixing means such as bolts.

The grinding wheel 40 includes an annular base 42, which is made of metal such as aluminum or stainless steel and is formed with substantially the same diameter as the mount 38. The base 42 is fixed on a side of an upper surface thereof on the side of the lower surface of the mount 38. On a side of a lower surface of the base 42, a plurality of grinding stones 44 is fixed. The grinding stones 44 are each formed, for example, in a regular parallelepipedal shape, and are arrayed in an annular configuration at substantially equal intervals along the peripheral direction of the base 42. The grinding stones 44 have been formed by fixing abrasive grains of diamond, cubic boron nitride (cBN), or the like with a binder (bonding material) such as a metal bond, resin bond, or vitrified bond. However, no limitations are imposed on the material, shape, structure, size, and the like of the grinding stones 44. Further, the number of the grinding stones 44 can be set as desired.

By power transmitted from the rotary drive source, which is connected to the proximal end portion of the spindle 36, via the spindle 36 and the mount 38, the grinding wheel 40 is rotated about an axis of rotation that is substantially perpendicular to the holding surface 6*a* of the chuck table 6 (substantially parallel to the Z-axis direction). In other words, the axis of rotation of the grinding wheel 40 is set along a direction perpendicular to the holding surface 6*a*.

The individual constituent elements (the chuck table 6, the moving mechanism 8, the moving mechanism 16, the grinding unit 28, and so on) of the grinding apparatus 2 are connected to a control unit (control part, control device) 46 that controls the grinding apparatus 2. By generating control signals for controlling operations of the constituent elements of the grinding apparatus 2, the control unit 46 controls the operation of the grinding apparatus 2. The control unit 46 is configured, for example, by a computer. Described specifically, the control unit 46 includes a computing section that performs computing needed for the operation of the grinding apparatus 2, and a storage section that stores a variety of information (data, a program, and so on) to be used for the operation of the grinding apparatus 2. The computing section is configured including a processor such as a central processing unit (CPU). On the other hand, the storage section is configured including memories, such as a read only memory (ROM) and a random access memory (RAM), which function as a main storage device and an auxiliary storage device.

While being held on the chuck table 6, the workpiece 11 is ground with the grinding unit 28. Described specifically, the rotating grinding stones 44 are brought into contact with the side of the upper surface of the workpiece 11 held on the chuck table 6, whereby the workpiece 11 is ground off on the side of the upper surface thereof. As a consequence, the workpiece 11 is ground and thinned.

Figure 2:
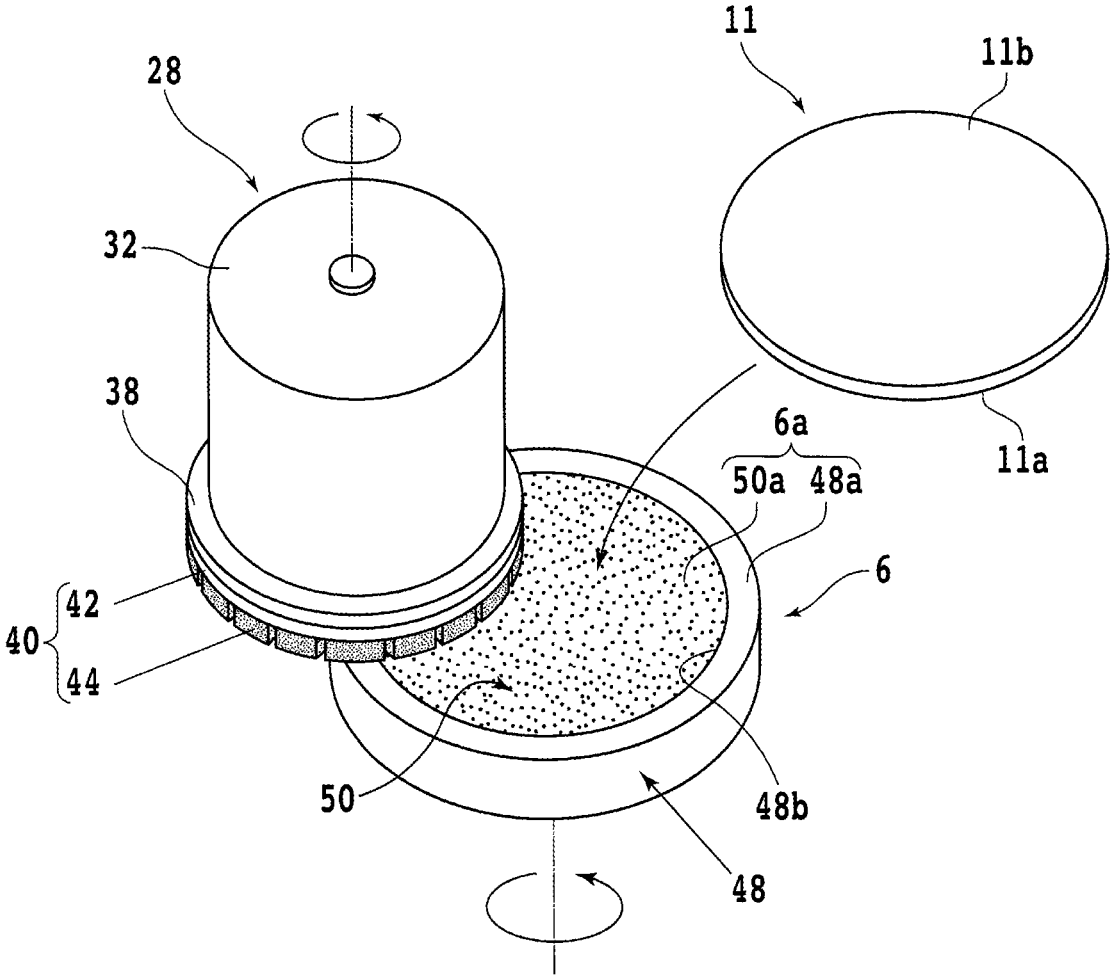
FIG. 2 is a perspective view illustrating the chuck table and a grinding unit in the grinding apparatus.

FIG. 2 is a perspective view illustrating the chuck table 6 and the grinding unit 28. The chuck table 6 includes a cylindrical frame body (main body) 48 made of metal such as stainless steel (SUS), glass, ceramics, or resin. In a central part on a side of an upper surface 48*a* of the frame body 48, a cylindrical recessed portion 48*b* is disposed concentrically with the frame body 48. A disc-shaped holding member 50 formed of a porous member of porous ceramics or the like is fitted in the recessed portion 48*b*. The holding member 50 internally includes pores (flow paths) communicating from an upper surface 50*a* to a lower surface of the holding member 50. The upper surface 50*a* of the holding member 50 functions as a suction surface for sucking the workpiece 11 when holding the workpiece 11 on the chuck table 6. The recessed portion 48*b* has a depth set substantially the same as the thickness of the holding member 50, so that the upper surface 48*a* of the frame body 48 and the upper surface 50*a* of the holding member 50 are disposed on substantially the same plane. The holding surface 6*a* of the chuck table 6 is formed by the upper surface 48*a* of the frame body 48 and the upper surface 50*a* of the holding member 50. The holding surface 6*a* is connected to a suction source (not illustrated) such as an ejector via the pores included in the holding member 50, a flow channel (not illustrated) formed inside the frame body 48, and a valve (not illustrated).

Figure 3:
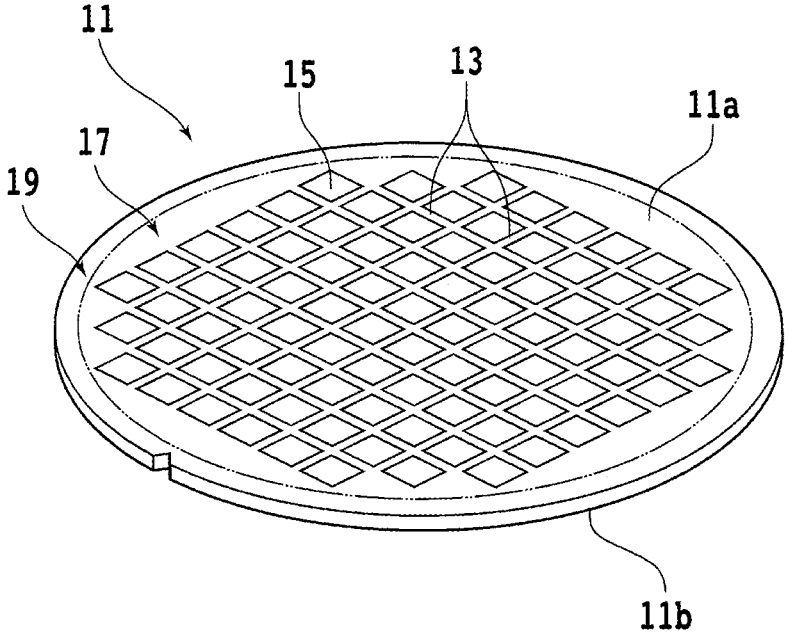
FIG. 3 is a perspective view depicting a workpiece.

FIG. 3 is a perspective view depicting the workpiece 11. The workpiece 11 is, for example, a disc-shaped wafer made of semiconductor such as silicon, and includes a front surface 11*a* and a back surface 11*b*, which are substantially parallel to each other. It is to be noted that treatment (chamfering) may have been applied to the workpiece 11 to remove corners formed on upper and lower ends of an outer peripheral edge (side wall) of the workpiece 11. In this case, the outer peripheral edge of the workpiece 11 is formed in a curved shape that extends from the front surface 11*a* to the back surface 11*b* of the workpiece 11 (see FIG. 1).

The workpiece 11 is defined into a plurality of rectangular regions by a plurality of streets (scheduled division lines) 13 arrayed in a grid pattern such that the streets 13 intersect each other. On the side of the front surface 11*a* of the regions defined by the streets 13, devices 15 such as integrated circuits (ICs), large scale integration (LSI) circuits, light emitting diodes (LEDs), or micro electro mechanical systems (MEMS) devices are formed, respectively. The workpiece 11 includes a substantially circular device region 17 where the devices 15 are formed, and an annular outer peripheral margin 19 which surrounds the device region 17. The outer peripheral margin 19 forms an annular region of a predetermined width (for example, approximately 2 mm) that includes the outer peripheral edge of the workpiece 11. In FIG. 3, the boundary between the device region 17 and the outer peripheral margin 19 is indicated by a two-dot chain line. By dividing the workpiece 11 in the grid pattern along the streets 13, a plurality of device chips is manufactured including the devices 15, respectively. By grinding and thinning the workpiece 11 before its division by the grinding apparatus 2 (see FIG. 1), thinned device chips can be obtained.

However, no limitations are imposed on the material, shape, structure, size, and the like of the workpiece 11. For example, the workpiece 11 may be a wafer (substrate) made of semiconductor (GaAs, InP, GaN, SiC, or the like) other than silicon, glass, ceramics, resin, metal, or the like. Further, no limitations are imposed either on the type, number, shape, structure, size, arrangement, and the like of the devices 15, and no devices 15 may be formed on the workpiece 11. Furthermore, the workpiece 11 may also be a package substrate such as a chip size package (CSP) substrate or a quad flat non-leaded package (QFN) substrate.

A description will next be made about a specific example of the workpiece processing method by use of the grinding apparatus 2. In the present embodiment, the workpiece 11 is ground using a grinding wheel 40A (see FIG. 4 etc.) for coarse grinding, and a grinding wheel 40B (see FIG. 7A etc.) for finish grinding.

Figure 4:
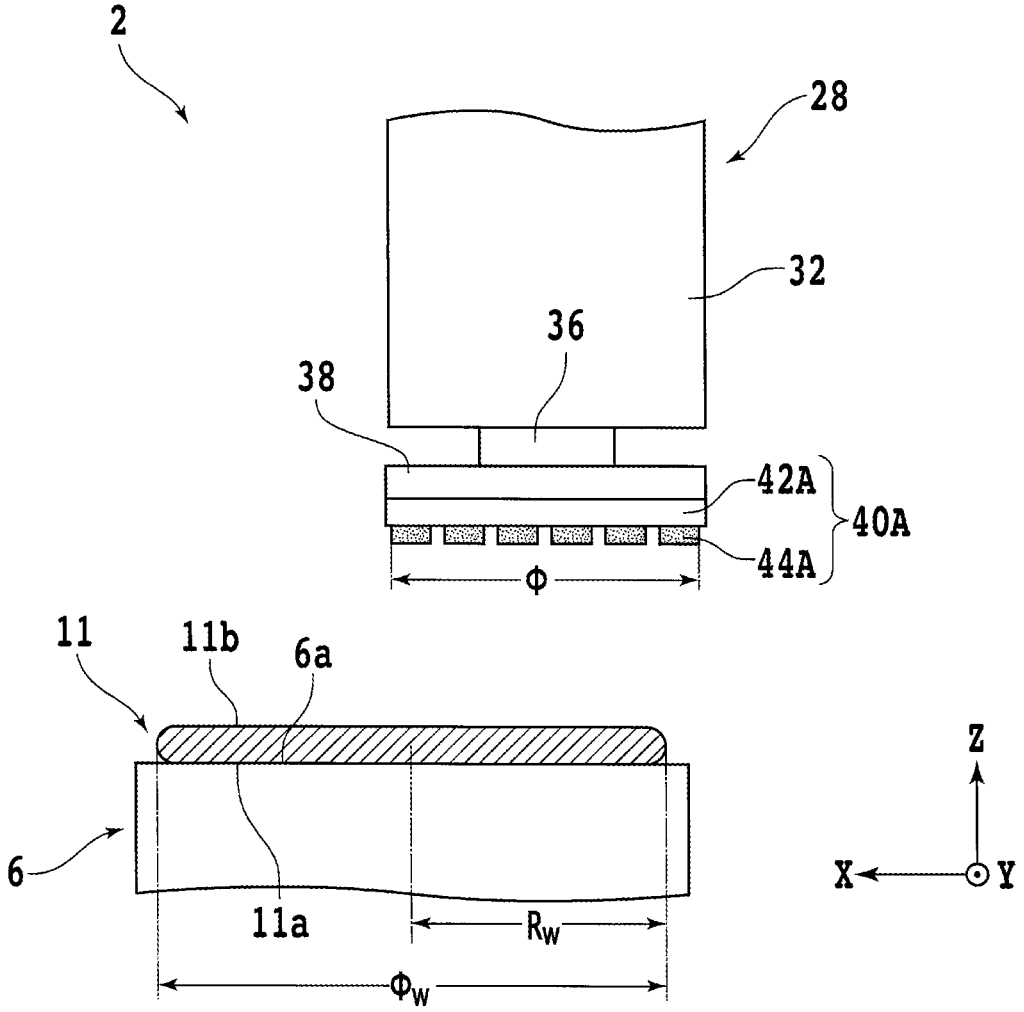
FIG. 4 is a partially cross-sectional side view illustrating the grinding apparatus in a holding step.

First, the workpiece 11 is held on the side of the front surface 11*a* thereof by the holding surface 6*a* of the chuck table 6 (holding step). FIG. 4 is a partially cross-sectional side view illustrating the grinding apparatus 2 in the holding step.

The workpiece 11 is placed on the chuck table 6 such that the workpiece 11 faces the holding surface 6*a* on the side of the front surface 11*a* and is exposed upward on the side of the back surface 11*b*. When a suction force (negative pressure) of the suction source is applied to the holding surface 6*a* in the above-described state, the workpiece 11 is held on the side of the front surface 11*a* under suction on the chuck table 6. On the side of the front surface 11*a* of the workpiece 11, a protective sheet may be bonded to protect the workpiece 11. The protective sheet may include, for example, a film-shaped base material formed in a circular shape, and an adhesive layer (glue layer) applied on the base material. The base material is made of resin such as polyolefin, polyvinyl chloride, or polyethylene terephthalate. The adhesive layer is made of an epoxy-based, acrylic, or rubber-based adhesive, or the like. By the protective sheet bonded to the side of the front surface 11*a* of the workpiece 11, the devices 15 (see FIG. 3) formed on the workpiece 11 are protected. The workpiece 11 is held on the holding surface 6*a* of the chuck table 6 via the protective sheet.

The chuck table 6 with the workpiece 11 held thereon is positioned below the grinding unit 28 by the moving mechanism 8 (see FIG. 1). The grinding wheel (first grinding wheel) 40A, which corresponds to the grinding wheel 40 for coarse grinding, is mounted on the grinding unit 28. The grinding wheel 40A includes an annular base (first base) 42A, and a plurality of grinding stones (first grinding stones) 44A. The base 42A and the grinding stones 44A are similar in material, structure, shape, and the like to the above-mentioned base 42 and grinding stones 44 (see FIG. 1), respectively. The grinding stones 44A each contain abrasive grains (first abrasive grains) for coarse grinding. As the first abrasive grains, diamond having an average grain size of 20 μm or greater and 60 μm or smaller is used, for example. The grinding stones 44A are arrayed in an annular pattern on the side of the lower surface of the base 42A.

When the spindle 36 is rotated, the grinding stones 44A each rotate about an axis of rotation that is substantially perpendicular to the holding surface 6*a* of the chuck table 6. In other words, the grinding stones 44A move along an annular moving path (rotation path) that is substantially parallel to a horizontal plane (X-Y plane). In FIG. 4, an outer diameter φ of the moving path of the grinding stones 44A is indicated. The outer diameter φ corresponds to the diameter of an annular trajectory to be drawn by end portions of the grinding stones 44A, the end portions being located on the side of an outer peripheral edge of the base 42A, when the grinding wheel 40A is rotated. On the other hand, the moving path of the grinding stones 44A has an inner diameter, which corresponds to the diameter of an annular trajectory to be drawn by end portions of the grinding stones 44A, the end portions being located on the side of a center of the base 42A, when the grinding wheel 40A is rotated.

The grinding wheel 40A is designed such that the outer diameter φ of the moving path of the grinding stones 44A becomes equal to or greater than a radius $R_w$ of the workpiece 11 and smaller than a diameter $\varphi_w$ of the workpiece 11. It is particularly preferred to design the grinding wheel 40A such that the inner diameter of the moving path of the grinding stones 44A becomes equal to or greater than the radius $R_w$ of the workpiece 11. If the workpiece 11 is an 8 inch silicon wafer, for example, the grinding stones 44A are arrayed such that the outer diameter φ of the moving path of the grinding stones 44A becomes equal to or greater than 100 mm and smaller than 200 mm.

Figure 5A:
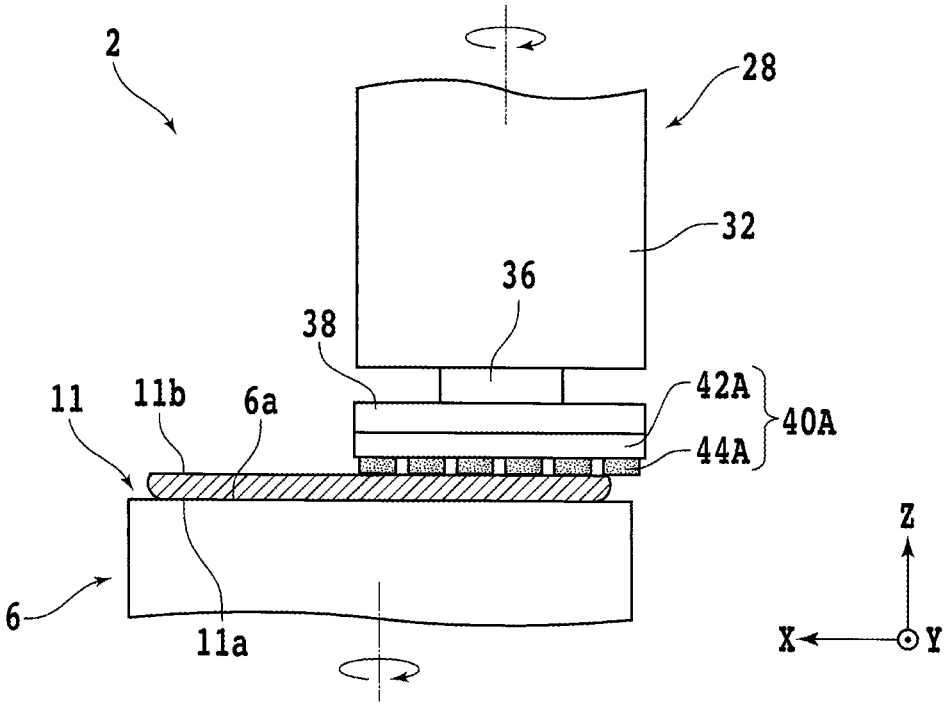
FIG. 5A is a partially cross-sectional side view illustrating the grinding apparatus in a coarse grinding step.

Next, the workpiece 11 is ground on the side of the back surface 11*b* thereof with the grinding stones 44A (coarse grinding step). FIG. 5A is a partially cross-sectional side view illustrating the grinding apparatus 2 in the coarse grinding step.

In the coarse grinding step, a positional relationship between the chuck table 6 and the grinding wheel 40A is adjusted such that the moving path of the grinding stones 44A overlaps the axis of rotation of the chuck table 6. Described specifically, the chuck table 6 is moved by the moving mechanism 8 (see FIG. 1) to position the chuck table 6 such that the axis of rotation of the chuck table 6 (the center of the holding surface 6*a* and a center of the workpiece 11) overlaps the grinding stone 44A located on a forward end portion (left end portion in FIG. 5A) of the grinding wheel 40A.

The grinding unit 28 is then lowered by the moving mechanism 16 (see FIG. 1) while the chuck table 6 and the grinding wheel 40A are rotated. As a consequence, the grinding wheel 40A is moved (fed for processing) relative to the chuck table 6 along the direction perpendicular to the holding surface 6*a* (the Z-axis direction), whereby the grinding stones 44A are brought closer to the workpiece 11. For example, the rotational speed of the chuck table 6 is set at 60 rpm or higher and 300 rpm or lower, and the rotational speed of the grinding wheel 40A is set at 3,000 rpm or higher and 6,000 rpm or lower. Further, the lowering speed (processing feed rate) of the grinding wheel 40A is set, for example, at 1 μm/s or higher and 6 μm/s or lower. When the grinding stones 44A come, at lower surfaces thereof, into contact with the back surface 11*b* of the workpiece 11, the workpiece 11 is ground off on the side of the entire back surface 11*b* thereof with the grinding stones 44A, whereby the workpiece 11 is thinned. When the workpiece 11 is thinned to a predetermined thickness, the lowering of the grinding unit 28 is stopped, and the coarse grinding of the workpiece 11 is completed.

It is to be noted that a grinding fluid supply channel (not illustrated) is disposed inside or near the grinding unit 28 to supply fluid (grinding fluid) such as pure water. When the workpiece 11 is ground by the grinding unit 28, the grinding fluid is supplied to the workpiece 11 and the grinding stones 44A. As a consequence, the workpiece 11 and the grinding stones 44A are cooled, and in addition, debris (ground debris) caused by the grinding processing is washed away.

Figure 5B:
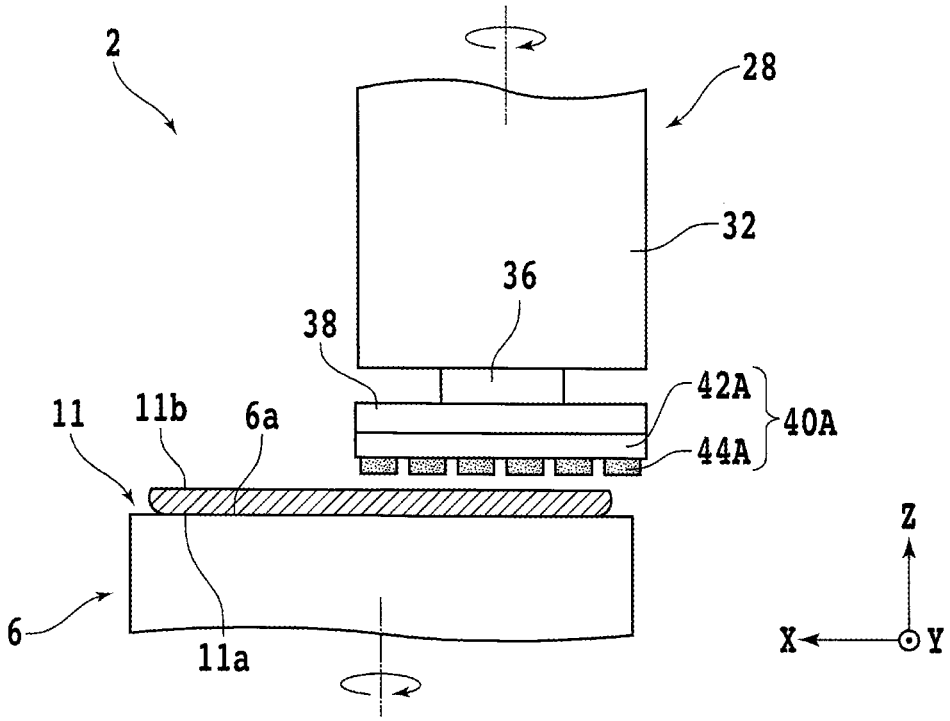
FIG. 5B is a partially cross-sectional side view illustrating the grinding apparatus in a separation step.

Next, the grinding stones 44A are separated from the workpiece 11 (separation step). FIG. 5B is a partially cross-sectional side view illustrating the grinding apparatus 2 in the separation step.

In the separation step, the grinding unit 28 is slightly lifted by the moving mechanism 16 (see FIG. 1), whereby the grinding stones 44A are separated from the back surface 11*b* of the workpiece 11. As a consequence, the workpiece 11 and the grinding stones 44A are brought into a state in which no friction acts therebetween, so that the workpiece 11 and the grinding stones 44A are cooled. As a result, the workpiece 11 is prevented from a processing failure such as surface burning. In an auxiliary grinding step to be described subsequently, the grinding stones 44A again come into contact with the workpiece 11 from the state in which the grinding stones 44A are apart from the workpiece 11. At that time, wearing will be promoted on the side of the lower surfaces of the grinding stones 44A, and therefore the conditions of the grinding stones 44A will be normalized.

Figure 6A:
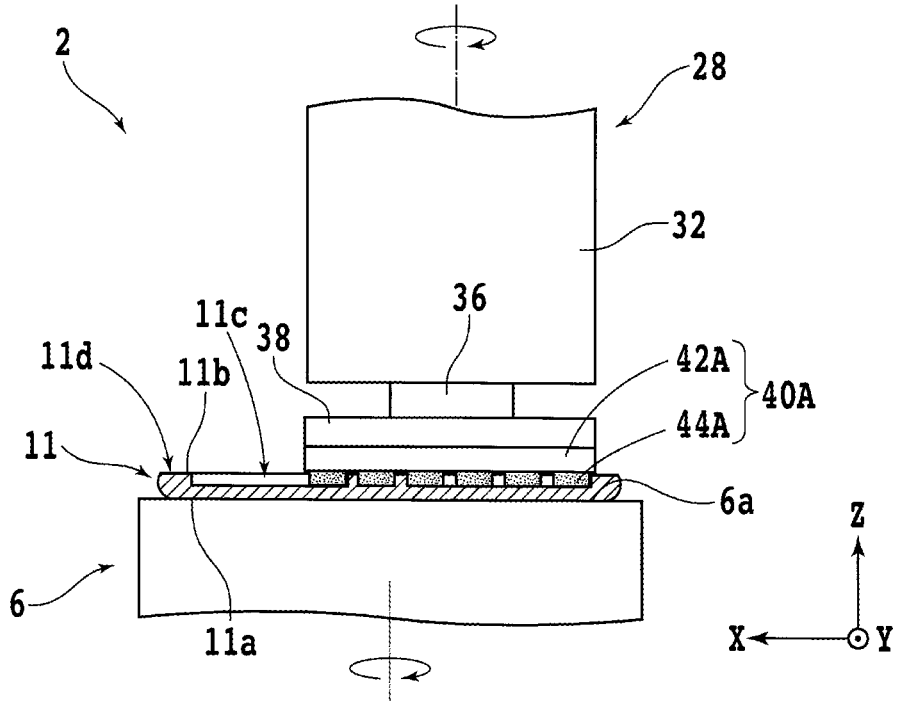
FIG. 6A is a partially cross-sectional side view illustrating the grinding apparatus in an auxiliary grinding step.

Next, the workpiece 11 is ground on the side of the back surface 11*b* thereof with the grinding stones 44A such that an unground region remains at an outer peripheral portion of the workpiece 11 (auxiliary grinding step). FIG. 6A is a partially cross-sectional side view illustrating the grinding apparatus 2 in the auxiliary grinding step.

In the auxiliary grinding step, the positional relationship between the chuck table 6 and the grinding wheel 40A is adjusted such that the grinding stones 44A overlaps an inner side of the outer peripheral edge of the workpiece 11. Described specifically, the chuck table 6 is moved by the moving mechanism 8 (see FIG. 1) to position the chuck table 6 such that all the grinding stones 44A are positioned closer to a center side (on the inner side in the radial direction) of the workpiece 11 than the outer peripheral edge of the workpiece 11 as viewed in plan. As a result, the grinding stones 44A are positioned such that they overlap the central portion of the workpiece 11 but do not overlap the outer peripheral portion of the workpiece 11.

The grinding unit 28 is then lowered by the moving mechanism 16 (see FIG. 1) while the chuck table 6 and the grinding wheel 40A are rotated. As a consequence, the grinding wheel 40A is moved (fed for processing) relative to the chuck table 6 along the direction perpendicular to the holding surface 6*a* (the Z-axis direction), whereby the grinding stones 44A are brought closer to the workpiece 11. For example, the rotational speed of the chuck table 6 is set at 60 rpm or higher and 300 rpm or lower, and the rotational speed of the grinding wheel 40A is set at 3,000 rpm or higher and 6,000 rpm or lower. Further, the lowering speed (processing feed rate) of the grinding wheel 40A is set, for example, at 1 μm/s or higher and 6 μm/s or lower.

When the grinding stones 44A come, at the lower surfaces thereof, into contact with the back surface 11*b* of the workpiece 11, the workpiece 11 is ground off on the side of the back surface 11*b* of the central portion thereof with the grinding stones 44A. As a result, an annular hollow 11*c* is formed in the central portion of the workpiece 11. On the other hand, the grinding stones 44A do not come into contact with the outer peripheral portion of the workpiece 11, so that the annular unground region 11*d* remains without being ground with the grinding stones 44A. When the hollow 11*c* is further ground to a predetermined depth, the lowering of the grinding unit 28 is stopped, and the auxiliary grinding of the workpiece 11 is completed.

Figure 6B:
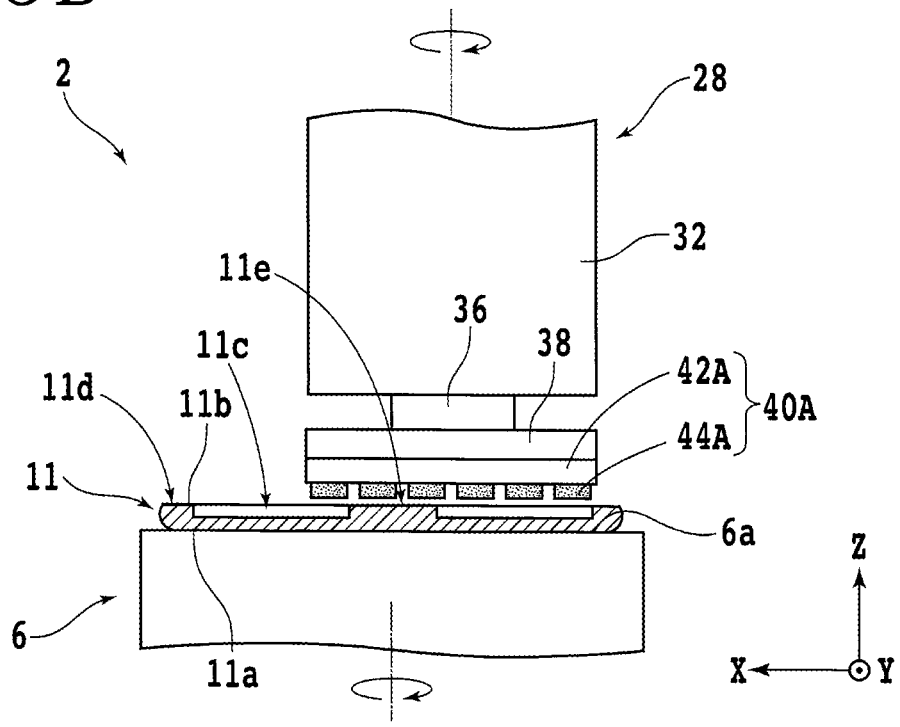
FIG. 6B is a partially cross-sectional side view illustrating the grinding apparatus after the auxiliary grinding step.

FIG. 6B is a partially cross-sectional side view illustrating the grinding apparatus 2 after the auxiliary grinding step. When the auxiliary grinding step is performed, the hollow 11*c* is formed in the workpiece 11 and, in addition, an unground region 11*d* remains on the workpiece 11. In a region within a certain range from the center of the workpiece 11, a cylindrical unground region 11*e* also remains without being ground with the grinding stones 44A.

It is to be noted that the separation step (see FIG. 5B) can be omitted by continuously performing the auxiliary grinding step after the coarse grinding step (see FIG. 5A). Described specifically, after the workpiece 11 has been ground to a predetermined thickness with the grinding stones 44A (see FIG. 5A), the grinding of the workpiece 11 with the grinding stones 44A may be continued while the chuck table 6 is moved along the X-axis direction such that the axis of rotation of the chuck table 6 comes closer to the axis of rotation of the grinding wheel 40A. In this case, the processing proceeds from the coarse grinding step to the auxiliary grinding step while the grinding stones 44A are kept in contact with the workpiece 11, and, with the grinding wheel 40A moving obliquely downward relative to the workpiece 11, the grinding stones 44A grind the workpiece 11 (slope grinding). On the side of the back surface 11*b* of the workpiece 11, the hollow 11*c* is consequently formed including an inclined inner wall. To the grinding unit 28, another moving mechanism (not illustrated) may be connected to move the grinding unit 28 along the X-axis direction. In this case, slope grinding can be also applied to the workpiece 11 by moving the grinding unit 28 along the X-axis direction and the Z-axis direction without moving the chuck table 6.

After the completion of the auxiliary grinding step, the grinding unit 28 is lifted by the moving mechanism 16 (see FIG. 1), and the grinding stones 44A are separated from the back surface 11*b* of the workpiece 11. The grinding wheel 40A is then dismounted from the mount 38, and the grinding wheel (second grinding wheel) 40B (see FIG. 7A), which corresponds to the grinding wheel 40 for finish grinding, is mounted on the mount 38.

The grinding wheel 40B includes an annular base (second base) 42B, and a plurality of grinding stones (second grinding stones) 44B. The base 42B and the grinding stones 44B are similar in material, structure, shape, and the like to the above-mentioned base 42A and grinding stones 44A, respectively. However, abrasive grains (second abrasive grains) contained in the grinding stones 44B have an average grain size smaller than that of the grits (first grits) contained in the grinding stones 44A. As the second abrasive grains, diamond having an average grain size of 0.5 μm or greater and 20 μm or smaller is used, for example. No particular limitation is imposed on the outer diameter of a moving path of the grinding stones 44B insofar as it is equal to or greater than the radius $R_w$ (see FIG. 4) of the workpiece 11. For example, the outer diameter of the moving path of the grinding stones 44B may be equal to or greater than the diameter φ (see FIG. 4) of the workpiece 11.

Figure 7A:
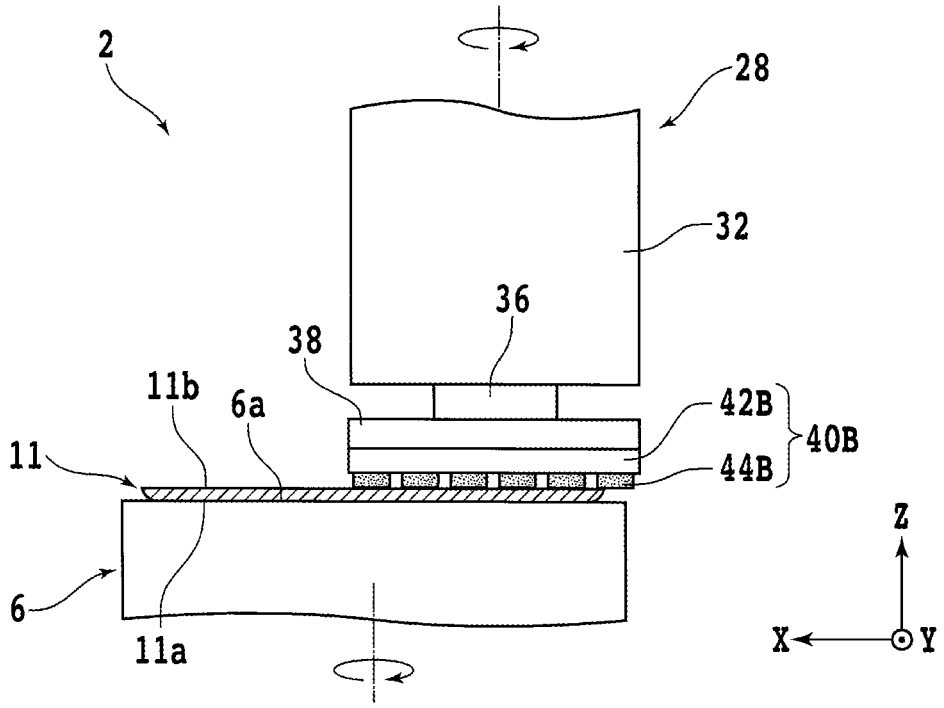
FIG. 7A is a partially cross-sectional side view illustrating the grinding apparatus in an unground region grinding step.

Next, the unground regions 11*d* and 11*e* are ground with the grinding stones 44B (unground region grinding step). FIG. 7A is a partially cross-sectional side view of the grinding apparatus 2 in the unground region grinding step.

In the unground region grinding step, the positional relationship between the chuck table 6 and the grinding wheel such 40B is adjusted that the moving path of the grinding stones 44B overlaps the axis of rotation of the chuck table 6. Described specifically, the chuck table 6 is moved by the moving mechanism 8 (see FIG. 1) to position the chuck table 6 such that the axis of rotation of the chuck table 6 (the center of the holding surface 6*a* and the center of the workpiece 11) overlaps the grinding stone 44B located on a forward end portion (left end portion in FIG. 7A) of the grinding wheel 40B.

The grinding unit 28 is then lowered by the moving mechanism 16 (see FIG. 1) while the chuck table 6 and the grinding wheel 40B are rotated. As a consequence, the grinding wheel 40B is moved (fed for processing) relative to the chuck table 6 along the direction perpendicular to the holding surface 6*a* (the Z-axis direction), whereby the grinding stones 44B are brought closer to the workpiece 11. For example, the rotational speed of the chuck table 6 is set at 60 rpm or higher and 300 rpm or lower, and the rotational speed of the grinding wheel 40B is set at 3,000 rpm or higher and 6,000 rpm or lower. Further, the lowering speed (processing feed rate) of the grinding wheel 40B is set, for example, at 0.5 μm/s or higher and 2 μm/s or lower. When the grinding stones 44B come, at lower surfaces thereof, into contact with the back surface 11*b* of the workpiece 11, the unground regions 11*d* and 11*e* (see FIG. 6B) which remain on the workpiece 11 are ground off with the grinding stones 44B. When the grinding stones 44B then reach the bottom of the hollow 11*c* of the workpiece 11, the removal of the unground regions 11*d* and 11*e* is completed.

As described above, the unground region 11*d* that remains at the outer peripheral portion of the workpiece 11 is ground and removed with the grinding stones 44B, which contain the abrasive grains of the small grain size, in the unground region grinding step. Therefore, processing failures such as chipping and/or cracking hardly occur at the outer peripheral portion of the workpiece 11 even if the grinding stones 44B hit the outer peripheral portion of the workpiece 11 when the unground region 11*d* is removed. In the unground region grinding step, the workpiece 11 with the center portion thereof locally thinned by the formation of the hollow 11*c* is ground with the grinding stones 44B. The removal amount hence decreases compared with a case in which the hollow 11*c* is not formed and the workpiece 11 is ground on the side of the entire back surface 11*b* thereof. This enables to quickly remove the unground regions 11*d* and 11*e* by increasing the feed rate.

Figure 7B:
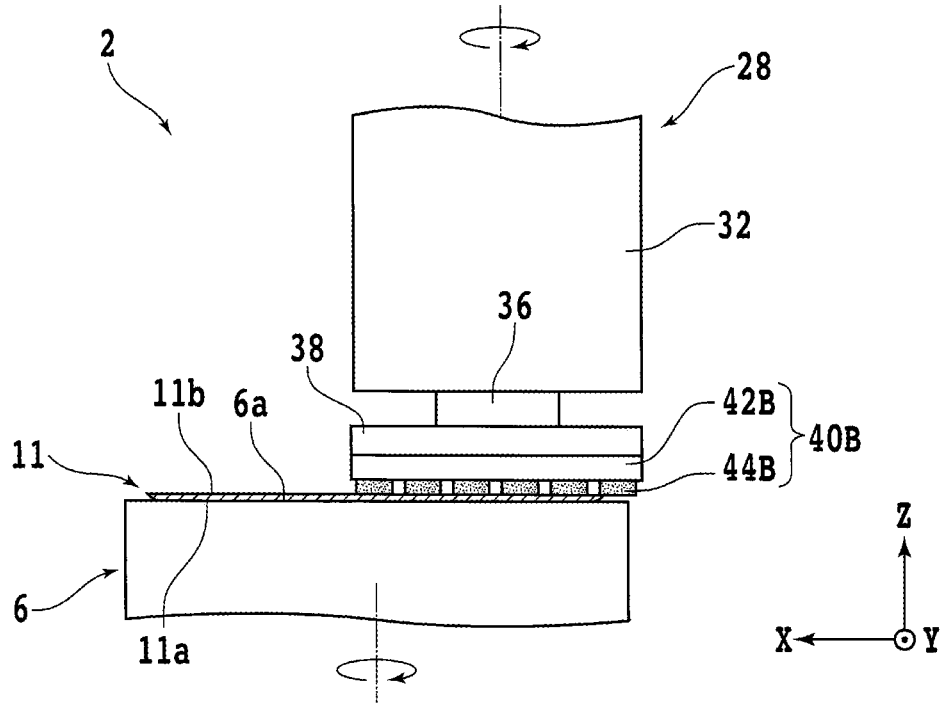
FIG. 7B is a partially cross-sectional side view illustrating the grinding apparatus in a finish grinding step.

Next, the workpiece 11 is ground on the side of the back surface 11*b* thereof with the grinding stones 44B (finish grinding step). FIG. 7B is a partially cross-sectional view illustrating the grinding apparatus 2 in the finish grinding step.

With the chuck table 6 and the grinding wheel 40B kept rotating after the completion of the unground region grinding step, the finish grinding step is performed by lowering the grinding wheel 40B. When the procedure proceeds from the unground region grinding step to the finish grinding step, it is preferred to reduce the lowering speed of the grinding wheel 40B and hence to make the lowering speed of the grinding wheel 40B slower in the finish grinding step than in the unground region grinding step. In this manner, the surface roughness of the workpiece 11 can be effectively reduced through the finish grinding. For example, the rotational speed of the chuck table 6 is set at 60 rpm or higher and 300 rpm or lower, and the rotational speed of the grinding wheel 40B is set at 3,000 rpm or higher and 6,000 rpm or lower. Further, the lowering speed (processing feed rate) of the grinding wheel 40B is set, for example, at 0.1 μm/s or higher and 1 μm/s or lower.

If the grinding wheel 40B is lowered further after the unground region grinding step, the workpiece 11 is ground off on the side of the entire back surface 11*b* thereof with the grinding stones 44B, and is thinned to a predetermined thickness. In the finish grinding step, the workpiece 11 is ground until its thickness reaches the target value (finish thickness) of the thickness of the final workpiece 11. Subsequently, the lowering of the grinding wheel 40B is stopped, and the finish grinding of the workpiece 11 is completed.

The above-described grinding of the workpiece 11 by the grinding apparatus 2 is realized through control of operations of the individual constituent elements of the grinding apparatus 2 by the control unit 46 (see FIG. 1). Described specifically, a program is stored in the storage section of the control unit 46. The program specifies a series of operations of the individual constituent elements of the grinding apparatus 2, which is needed to sequentially perform the holding step, the coarse grinding step, the separation step, the auxiliary grinding step, the unground region grinding step, and the finish grinding step. When the grinding of the workpiece 11 is performed, the control unit 46 reads the program from the storage section, executes the program, and outputs control signals to the individual constituent elements of the grinding apparatus 2. In this manner, the operation of the grinding apparatus 2 is controlled, and the processing method of a workpiece according to the present embodiment is performed automatically.

The workpiece 11 which has been ground by the grinding apparatus 2 is cut, for example, along the streets 13 (see FIG. 3), and is divided into the device chips with the devices 15 included therein respectively. For the division of the workpiece 11, a cutting apparatus that cuts the workpiece 11 by an annular cutting blade or a laser processing apparatus that processes the workpiece 11 by irradiation of a laser beam is used.

As described above, the grinding stones 44A with the abrasive grains of the large grain size contained therein and the grinding stones 44B with the abrasive grains of the small grain size contained therein are used in the processing method according to the present embodiment. Following the coarse grinding of the workpiece 11 with the grinding stones 44A, the workpiece 11 is ground with the grinding stones 44A such that the unground region 11*d* remains at the outer peripheral portion of the workpiece 11. Subsequently, with the grinding stones 44B, the unground region 11*d* is ground and removed, and the finish grinding of the workpiece 11 is performed. If the above-described processing method is used, the outer peripheral portion of the workpiece 11 is ground with the grinding stones 44B with the abrasive grains of the small grain size contained therein, so that the occurrence of processing failures at the outer peripheral portion of the workpiece 11 is suppressed. Further, the workpiece 11 is beforehand removed at the central portion thereof with the grinding stones 44A with the abrasive grains of the large grain size contained therein before the outer peripheral portion of the workpiece 11 is ground with the grinding stones 44B. The processing feed rate can thus be increased when the outer peripheral portion of the workpiece 11 is ground with the grinding stones 44B. It is accordingly possible to shorten the time to grind the workpiece 11 while the occurrence of processing failures at the outer peripheral portion of the workpiece 11 is suppressed.

In the above-described embodiment, the description is made about the case in which, after the coarse grinding step and the auxiliary grinding step have been performed, the grinding wheel 40A (see FIG. 6B etc.) is replaced with the grinding wheel 40B (see FIG. 7A etc.), and the unground region grinding step and the finish grinding step are performed. As an alternative, however, the grinding apparatus 2 may include two grinding units 28 in combination. In this case, the coarse grinding step and the auxiliary grinding step are performed by one of the grinding units 28 on which the grinding wheel 40A is mounted, and the unground region grinding step and the finish grinding step are performed by the other grinding unit 28 on which the grinding wheel 40B is mounted. This enables to omit the replacement work of the grinding wheel. As another alternative, the workpiece 11 may be processed by two grinding apparatus 2. In this case, the grinding wheel 40A is mounted on the grinding unit 28 of one of the grinding apparatuses 2, and the grinding wheel 40B is mounted on the grinding unit 28 of the other grinding apparatus 2. Then, the coarse grinding step and the auxiliary grinding step are performed with the one grinding apparatus 2, and the unground region grinding step and the finish grinding step are performed with the other grinding apparatus 2.

Moreover, the above-described structures, methods, and the like according to the above embodiment can be practiced with modifications as needed within the scope not departing from the objects of the present invention.

The present invention is not limited to the details of the above-described preferred embodiment. The scope of the invention is defined by the appended claims and all changes and modifications as fall within the equivalence of the scope of the claims are therefore to be embraced by the invention.

What is claimed is:

1. A processing method of grinding a workpiece, comprising:

a holding step of holding the workpiece on a side of a front surface thereof on a holding surface of a chuck table having an axis of rotation set along a direction perpendicular to the holding surface;

a coarse grinding step of, after performing the holding step, adjusting a positional relationship between the chuck table and a first grinding wheel such that a moving path of first grinding stones, which are included on the first grinding wheel and contain first abrasive grains, overlaps the axis of rotation of the chuck table, and grinding the workpiece on an entire side of a back surface thereof with the first grinding stones until the workpiece has a predetermined thickness;

an auxiliary grinding step of, after performing the coarse grinding step, adjusting the positional relationship between the chuck table and the first grinding wheel such that the first grinding stones overlap an inner side of an outer peripheral edge of the workpiece, and grinding the workpiece on the side of the back surface thereof with the first grinding stones such that an unground region remains at an outer peripheral portion of the workpiece;

an unground region grinding step of, after performing the auxiliary grinding step, adjusting a positional relationship between the chuck table and a second grinding wheel such that a moving path of second grinding stones, which are included on the second grinding wheel and contain second abrasive grains having a smaller average grain size than that of the first abrasive grains, overlaps the axis of rotation of the chuck table, and grinding the unground region with the second grinding stones; and a finish grinding step of, after performing the unground region grinding step, grinding the workpiece on the side of the back surface thereof with the second grinding stones until the workpiece has a predetermined finish thickness.

2. The processing method according to claim 1, further comprising:

a separation step of, after performing the coarse grinding step and before performing the auxiliary grinding step, separating the workpiece and the first grinding stones from each other.

3. The processing method according to claim 1, wherein the workpiece is a semiconductor wafer having a disc shape.

4. The processing method according to claim 3, wherein the first grinding stones are arrayed in an annular configuration and the second grinding stones are arrayed in an annular configuration.

5. The processing method according to claim 4, wherein an outer diameter of the moving path of the first grinding stones is equal to or greater than a radius of the workpiece and smaller than a diameter of the workpiece.

6. The processing method according to claim 5, wherein an inner diameter of the moving path of the first grinding stones is equal to or greater than the radius of the workpiece.

7. The processing method according to claim 1, wherein the first grinding stones are arrayed in an annular configuration and the second grinding stones are arrayed in an annular configuration.

8. The processing method according to claim 1, wherein the coarse grinding step, the auxiliary grinding step, the unground region grinding step, and the finish grinding step are performed automatically by at least one grinding unit.

9. The processing method according to claim 1, wherein the first abrasive grains have average grain size between 20 μm and 60 μm and the second abrasive grains have an average grain size between 0.5 μm and 20 μm.

10. The processing method according to claim 9, wherein the first abrasive grains and the second abrasive grains are made of diamond.

11. The processing method according to claim 1, wherein during the coarse grinding step, rotational speed of the chuck table is set between 60 rpm and 300 rpm, and rotational speed of the first grinding wheel is set between 3,000 rpm and 6,000 rpm and, a processing feed rate at which the positional relationship between the chuck table and the first grinding wheel are moved toward each other is set between 1 μm/s and 6 μm/s.

12. The processing method according to claim 1, wherein during the auxiliary grinding step, rotational speed of the chuck table is set between 60 rpm and 300 rpm, and rotational speed of the first grinding wheel is set between 3,000 rpm and 6,000 rpm and, a processing feed rate at which the positional relationship between the chuck table and the first grinding wheel are moved toward each other is set between 1 μm/s and 6 μm/s.

13. The processing method according to claim 1, wherein during the auxiliary grinding step an annular hollow region is formed in a central portion of the workpiece and wherein the first grinding stones do not come into contact with the outer peripheral portion of the workpiece so that the unground region remains without being ground with the first grinding stones during the auxiliary step.

14. The processing method according to claim 13, wherein after the auxiliary grinding step, a cylindrical region also remains without being ground with the first grinding stones during the auxiliary step.

15. The processing method according to claim 1, wherein during the unground region grinding step, rotational speed of the chuck table is set between 60 rpm and 300 rpm, and rotational speed of the first grinding wheel is set between 3,000 rpm and 6,000 rpm, a processing feed rate at which the positional relationship between the chuck table and the first grinding wheel are moved toward each other is set between 0.5 μm/s and 2 μm/s.

16. The processing method according to claim 15, wherein during the finish grinding step the rotational speed of the chuck table is set between 60 rpm and 300 rpm, and rotational speed of the first grinding wheel is set between 3,000 rpm and 6,000 rpm and, the processing feed rate at which the positional relationship between the chuck table and the first grinding wheel are moved toward each other is set between 0.1 μm/s and 1 μm/s.

17. The processing method according to claim 1, a processing feed rate at which the positional relationship between the chuck table and the first grinding wheel are moved toward each other is lower during the finish grinding step than the unground region grinding step.

18. A processing method of grinding a workpiece, comprising:

a holding step of holding the workpiece on a side of a front surface thereof on a holding surface of a chuck table having an axis of rotation set along a direction perpendicular to the holding surface;

a coarse grinding step of, after performing the holding step, adjusting a positional relationship between the chuck table and a first grinding wheel such that a moving path of first grinding stones, which are included on the first grinding wheel and contain first abrasive grains, overlaps the axis of rotation of the chuck table, and grinding the workpiece on a side of a back surface thereof with the first grinding stones until the workpiece has a predetermined thickness;

an auxiliary grinding step of, after performing the coarse grinding step, adjusting the positional relationship between the chuck table and the first grinding wheel such that the first grinding stones overlap an inner side of an outer peripheral edge of the workpiece, and grinding the workpiece on the side of the back surface thereof with the first grinding stones such that an unground region remains at an outer peripheral portion of the workpiece;

a separation step of, after performing the coarse grinding step and before performing the auxiliary grinding step, separating the workpiece and the first grinding stones from each other;

an unground region grinding step of, after performing the auxiliary grinding step, adjusting a positional relationship between the chuck table and a second grinding wheel such that a moving path of second grinding stones, which are included on the second grinding wheel and contain second abrasive grains having a smaller average grain size than that of the first abrasive grains, overlaps the axis of rotation of the chuck table, and grinding the unground region with the second grinding stones; and a finish grinding step of, after performing the unground region grinding step, grinding the workpiece on the side of the back surface thereof with the second grinding stones until the workpiece has a predetermined finish thickness.

* * * * *